US006068505A

United States Patent [19]

Sai

[11] Patent Number: 6,068,505

[45] Date of Patent: May 30, 2000

[54] ELECTRICAL CONTACT FOR FLEXIBLE FLAT CABLE

[75] Inventor: Noriaki Sai, Kanagawa, Japan

[73] Assignee: The Whitaker Corporation, Wilmington, Del.

[21] Appl. No.: 09/213,830

[22] Filed: Dec. 17, 1998

[30] Foreign Application Priority Data

Dec. 26, 1997 [JP] Japan ..... 9-367925

[51] Int. Cl.[7] ..... H01R 4/24

[52] U.S. Cl. ..... 439/422; 439/877

[58] Field of Search ..... 439/422, 423, 439/424, 862, 877

[56] References Cited

U.S. PATENT DOCUMENTS

| | | | |
|---|---|---|---|
| 4,082,402 | 4/1978 | Kinkaid et al. | 439/422 |
| 4,915,650 | 4/1990 | Daly et al. | 439/498 |
| 5,137,468 | 8/1992 | Murakami | 439/422 |
| 5,681,190 | 10/1997 | Childs | 439/856 |

FOREIGN PATENT DOCUMENTS 8-47810 12/1997 Japan .

OTHER PUBLICATIONS

Japanese Design Patent No. 883975, similarity 1 Jun. 1995.

*Primary Examiner*—Michael L. Gellner
*Assistant Examiner*—Barry M. L. Standig

[57] ABSTRACT

The present invention provides an electrical contact for a flexible flat electrical cable which allows connection with a high contact pressure and holding force, but which does not damage the conductor. The contact section (10) of the electrical contact (1) has two plates (2, 4), which have protruding ribs (14*a,* 14*b;* 16*a,* 16*b*). The plates (2, 4) are connected by a connecting member (6); a flat cable (50) is accommodated between the plates (2, 4), and the cable is held between plates (2, 4) by securing members (18, 20), which are disposed in the vicinity of the protruding ribs (14*a,* 14*b;* 16*a,* 16*b*) on the side edges of the plate (4).

7 Claims, 4 Drawing Sheets

ELECTRICAL CONTACT FOR FLEXIBLE FLAT CABLE

FIELD OF THE INVENTION

The present invention is directed to an electrical contact and more specifically relates to an electrical contact for a flexible flat electrical cable.

BACKGROUND OF THE INVENTION

Electrical terminal 100 disclosed in Japanese Design Registration No. 883975 is universally known as a terminal for flexible flat electrical cables, i.e., cables in which the conductor is flat and flexible. As shown in FIG. 9, terminal 100 is constructed as follows: i.e., the conductor of a flat cable (not shown) is positioned between a base plate 102 and a clamping plate 104 extends from the base plate 102; then, the clamping plate 104 is closed, and a securing member 106 at an end of clamping plate 104 is bent and superimposed on an undersurface of the base plate 102 so that electrical connection with the flat cable is accomplished.

Furthermore, a construction in which a flat conductor cable is connected to an electrical contact, which has a crimping member is described in Japanese Utility Model Application No. 7-47810. A crimping member is caused to pierce the cable; afterward, an end is bent toward the cable so that electrical connection with the cable is accomplished.

In the terminal described in the Japanese Design Registration, a pressure connection is performed at the end portion of the long, slender clamping plate 104; accordingly, the intermediate portion of the clamping plate 104, which constitutes an electrical-connecting section is removed from the pressure-connection section, therefore it cannot apply a large contact pressure. Furthermore, there is a danger that the central portion of the clamping plate 104 will bulge outward, so that there are problems in terms of the reliability of the electrical connection. Furthermore, the pressure-connection force with respect to the cable is insufficient, so that the problem of a weak cable-holding force also arises.

Furthermore, although a high contact pressure is obtained in the Japanese Utility Model Application, there is a danger that the crimping member will scrape and damage the conductor of the cable.

SUMMARY OF THE INVENTION

The present invention was devised in light of the above points; the object of the present invention is to provide an electrical contact for a flexible flat electrical cable which has a high-holding force and a high-contact pressure, but which does not damage the conductor.

An electrical contact for a flexible flat electrical cable of the present invention comprises a contact section including facing plates which are integrally connected at one edge by a connecting member, and which are separated from each other in a substantially parallel configuration, and a wire-connecting section for an electrical wire which is a continuation of one of the plates, projections are located on a facing surface of at least one of the plates, and securing members for securing the plates to each other are disposed on both side edges of at least one of the plates in the vicinity of the projections so that the other plate is guided toward the one plate.

The projections disposed on the inside surfaces of the facing plates are a plurality of protruding ribs which extend in a direction perpendicular to an axial direction of the contact, i.e., in the direction of length of the contact.

The securing members are disposed in positions which are such that a securing force is applied in the direction of the protruding ribs. Furthermore, it is desirable that the securing members protrude beyond the other plate prior to being bent to their secured positions.

The securing members are bent substantially at right angles onto the other plate, i.e., on an upper surface, during the bending operation.

It is desirable that the upper and lower plates approach each other in a mutually parallel relationship during the securing operation.

An electrical contact for electrical connection to a flexible flat electrical cable comprises a contact section including spaced plates with one of the spaced plates having inwardly-directed projections and a conductor-connection section extending outwardly from one of the plates for electrical connection to an electrical conductor, wherein the spaced plates are integrally connected by a connecting member along one edge so that the plates are disposed parallel to one another, and securing members are disposed on side edges of the one of the spaced plates which guide a section of the flexible flat electrical cable between the spaced parallel plates and also guide the other of the spaced plates toward the one of the spaced plates as the securing members are bent onto the other of the spaced plates thereby pressing the section of the flexible flat electrical cable between the plates and forming an electrical connection therebetween.

BRIEF DESCRIPTION OF THE DRAWINGS

Embodiments of the present invention will now be described by way of example with reference to the accompanying drawings in which.

DETAILED DESCRIPTION OF THE INVENTION

Figure 1:
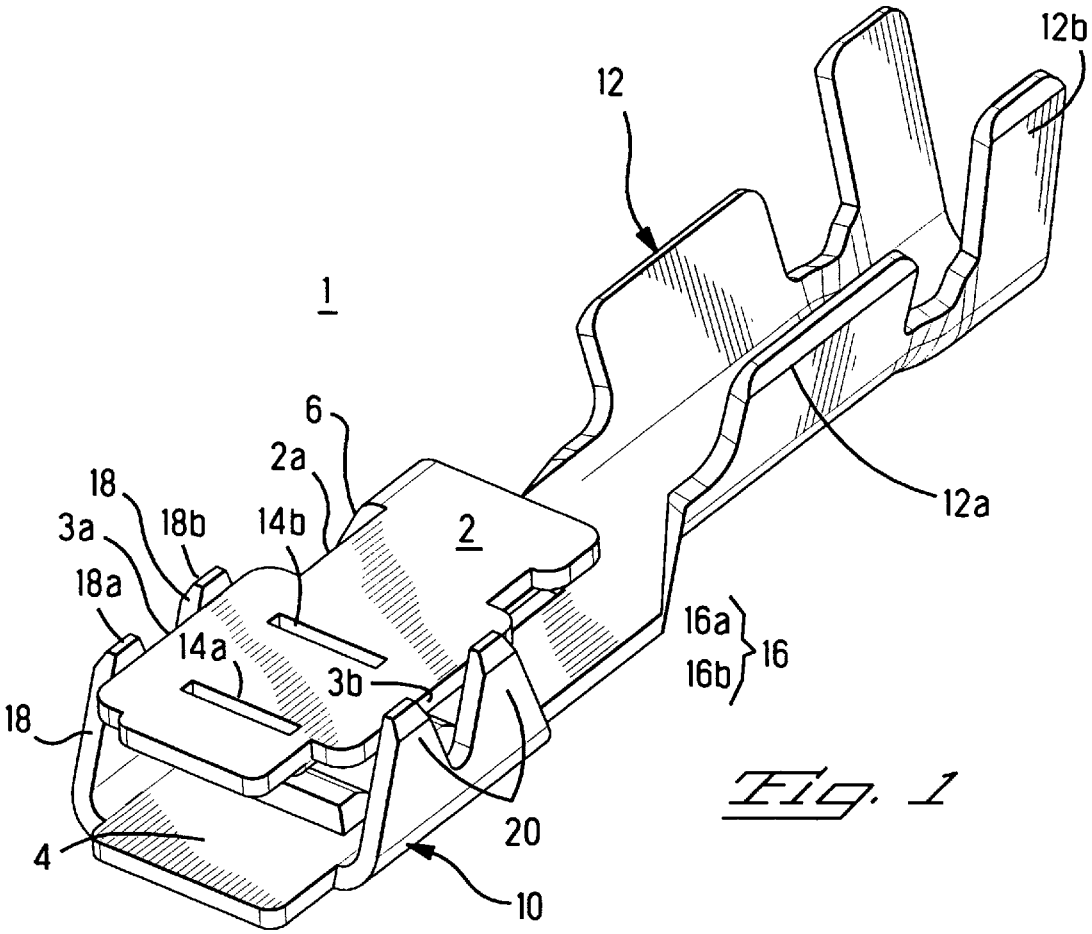
FIG. 1 is a perspective view of an electrical contact for a flexible flat electrical cable of the present invention.
Figure 2:
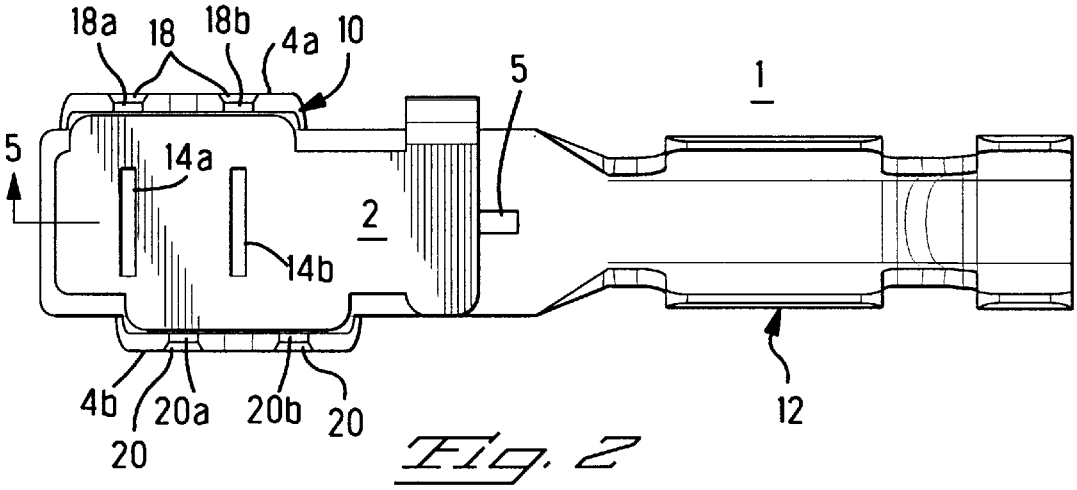
FIG. 2 is a plan view of the electrical contact shown in FIG. 1.
Figure 3:
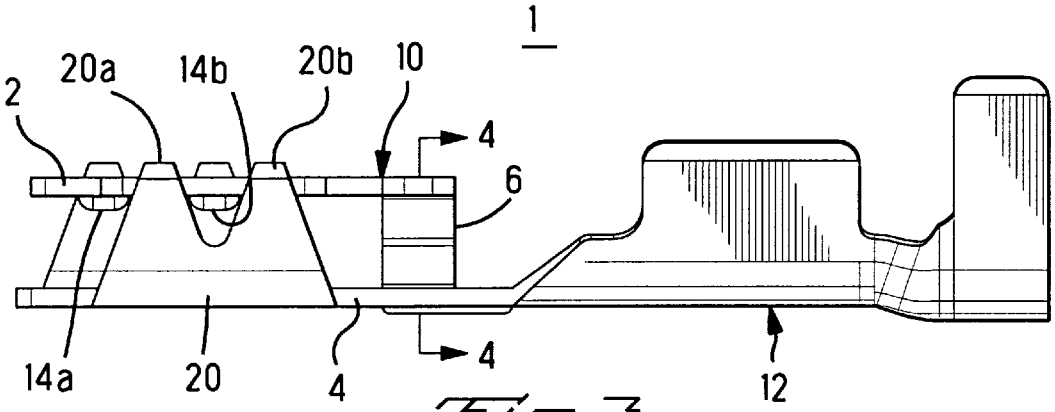
FIG. 3 is a side view of the electrical contact shown in FIG. 1.

The following description of electrical contact 1 will refer to FIGS. 1 through 3. The contact 1 has a contact section 10 which has two plates 2 and 4 that are separated from each other and positioned substantially parallel to each other, and a wire-connecting section 12 for electrical connection to an electrical wire which extends rearward from a rear end of the contact section 10 as an integral continuation thereof.

The plates 2, 4 have a substantially rectangular shape, and a flexible flat electrical cable 50 (see FIG. 6) is inserted between the plates 2, 4. Two projections 14*a*, 14*b*, which are separated from each other in the axial direction of the contact 1, i.e., protruding ribs 14*a*, 14*b* or 16*a*, 16*b*, are respectively formed by pressing so that the ribs protrude toward the opposite surface in positions located further toward the front than the centers of the respective plates 2, 4. A set of securing members 18, 20 are integrally formed on both side edges 4*a*, 4*b* of lower plate 4 by bending upward. The ends 18*a*, 18*b* of the securing members 18 are respectively positionally aligned with the protruding ribs 14*a*, 14*b*. The securing members 20 are positionally shifted in the axial direction relative to the securing members 18, and the ends 20*a*, 20*b* of the securing members 20 are positionally shifted to the rear by a half-pitch with respect to the pitch between the ends 18*a*, 18*b* of securing members 18 and they are aligned with protruding ribs 16*a*, 16*b*. The side edges 4*a*, 4*b* corresponding to the securing members 18, 20 of the respective plates 2, 4 have an increased width. Furthermore, the securing members 18, 20 are disposed in close proximity to extensions 3*a*, 3*b* of plate 2.

The wire-connecting section 12 includes an insulation barrel 12*b*, which is crimped onto the insulating outer covering of an electrical wire W (FIG. 7), and a conductor barrel 12*a*, which is crimped onto the electrical conductor from which the outer covering has been stripped, as in common conventional practice. Since these are known constructions, a detailed description is omitted here. Furthermore a bead 5 is formed in the transition section between the contact section and the wire-connecting section in order to increase the rigidity of the contact 1.

As shown most clearly in FIGS. 1 and 2, the securing members 18, 20 are each constructed as two triangular members connected at the intermediate point, and the ends 18*a*, 18*b*; 20*a*, 20*b* of the securing members 18, 20 are bent substantially at right angles and bent onto the upper plate 2; details of which will be described later.

Figure 4:
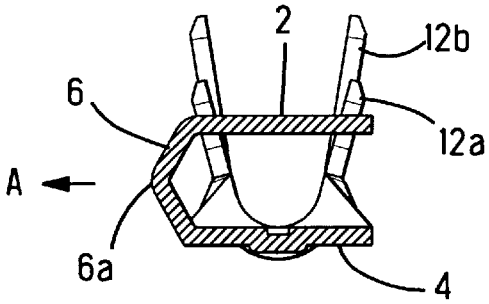
FIG. 4 is a cross-sectional view taken along line 4—4 in FIG. 3.

Referring to FIG. 4, connecting member 6, which is formed as an integral part of the respective side edges 2*a*, 4*a* of the upper plate 2 and lower plate 4 is substantially V-shaped in cross section. This is done so that bending at an intermediate point of the connecting member 6 is facilitated when the plates 2, 4 are caused to approach each other and a cable is pressed between the plates 2, 4. Accordingly, the plate 2 can easily be moved toward the plate 4 while being maintained substantially parallel to the plate 4. In this case, the intermediate portion 6*a* of the connecting member 6 protrudes in the direction indicated by arrow A, and the plate 2 is guided by the securing members 18, 20, so that the plates 2, 4 can be moved toward each other without any shift in position. As a result of these actions, electrical connection can be accomplished during the movement of plate 2 toward plate 4 without scraping the carbon that constitutes the electrode of the cable 50.

Figure 5:
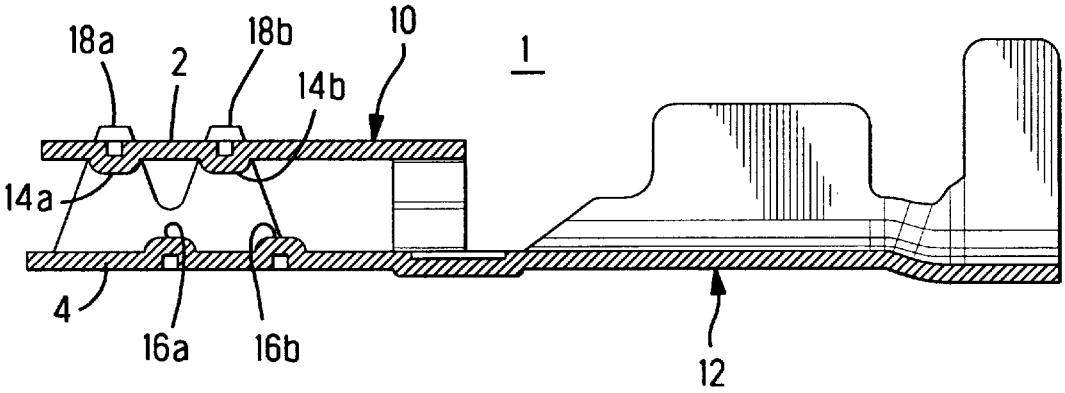
FIG. 5 is a cross-sectional view taken along line 5—5 in FIG. 2.

Next, referring to FIG. 5, the positional relationship of the protruding ribs 14*a*, 14*b*; 16*a*, 16*b* on the inside surfaces of the plates 2, 4 is clearly shown. The protruding ribs 16*a*, 16*b* are each positionally shifted to the rear by one-half pitch relative to the protruding ribs 14*a*, 14*b*. Specifically, it is seen that the ends 18*a*, 18*b* of the securing members 18 act to press the protruding ribs 14*a*, 14*b* of the upper plate 2 downward, and that the ends 20*a*, 20*b* of the securing members 20 act to press the upper plate 2 toward the lower protruding ribs 16*a*, 16*b*.

Figure 6:
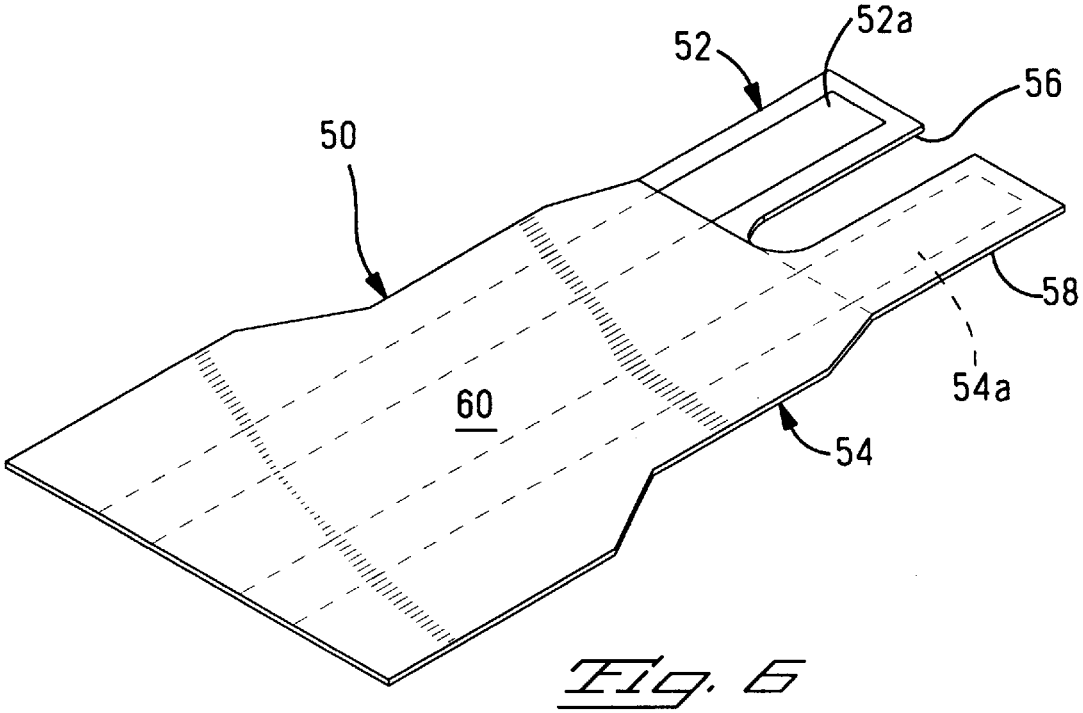
FIG. 6 is a perspective view of a flexible flat electrical cable.

Next, FIG. 6 shows a perspective view of the flexible flat electrical cable 50 that is connected to the contact 1 of the present invention. The cable 50 is formed by adhering together two plastic films 52, 54 on which conductive paths 52*a*, 54*a* are formed, so that the films 52, 54 face each other. The films 52, 54 have the same shape. In the film 52, a carbon conductive path 52*a*, which has a silver conductive path on the inside is formed on the front surface of the film 52. In the film 54, a similar conductive path 54*a* is formed on the back surface thereof.

End portions of the respective films 52, 54 are formed into contact members 56, 58 which are displaced to one side. The conductive paths 52*a*, 54*a* extend along contact members 56, 58, and they are exposed. Portions of the contact members 56, 58 are inserted into the respective contact sections 10 of a pair of contacts 1, and are electrically connected thereto. In this case, the exposed conductive paths 52*a*, 54*a* are electrically connected to the protruding ribs 14*a*, 14*b*, or 16*a*, 16*b*. The main body portion 60 of the cable extends to the outside from the contacts 1, and a housing (not shown), which covers the contacts 1 is disposed (for example) under an automobile seat. When a person sits in this seat, the body weight of the person acts on a sensor (not shown) which is connected to the cable 50, so that the sensor activates a sensor circuit (not shown).

Figure 7:
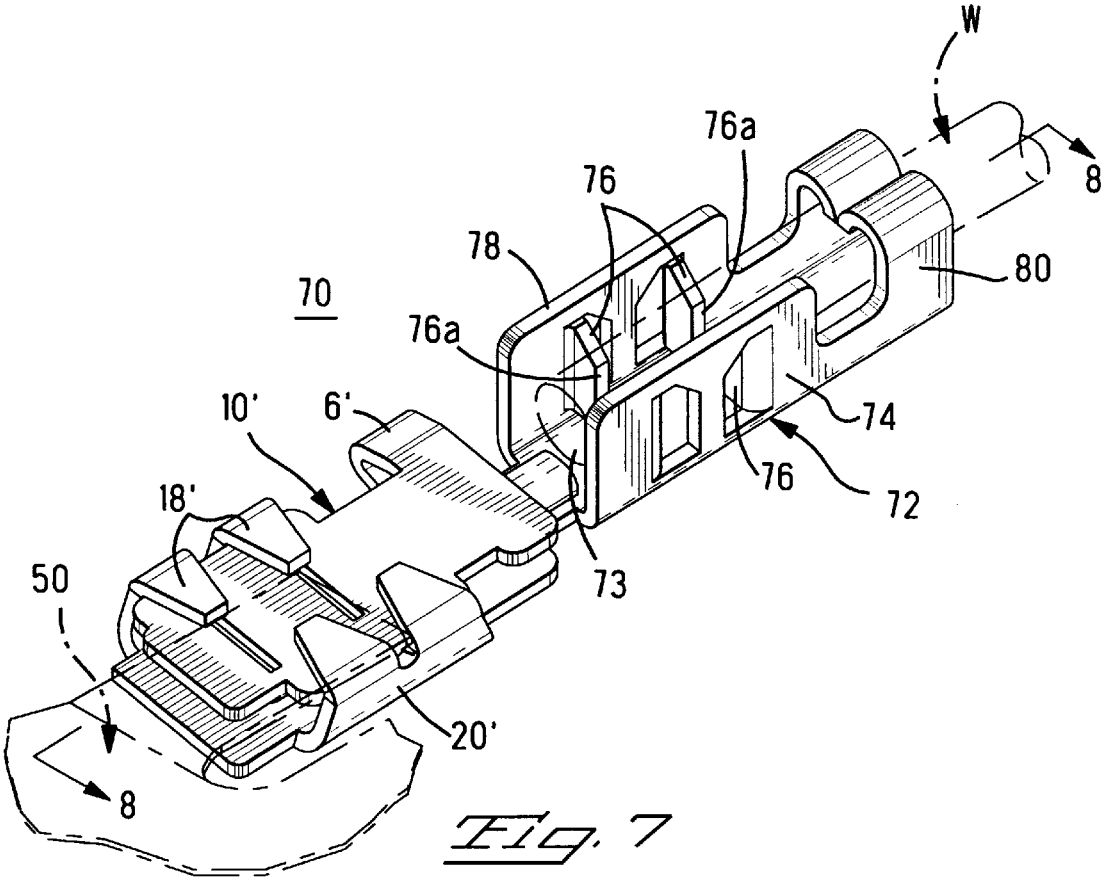
FIG. 7 is a perspective view of an embodiment of the electrical contact.
Figure 8:
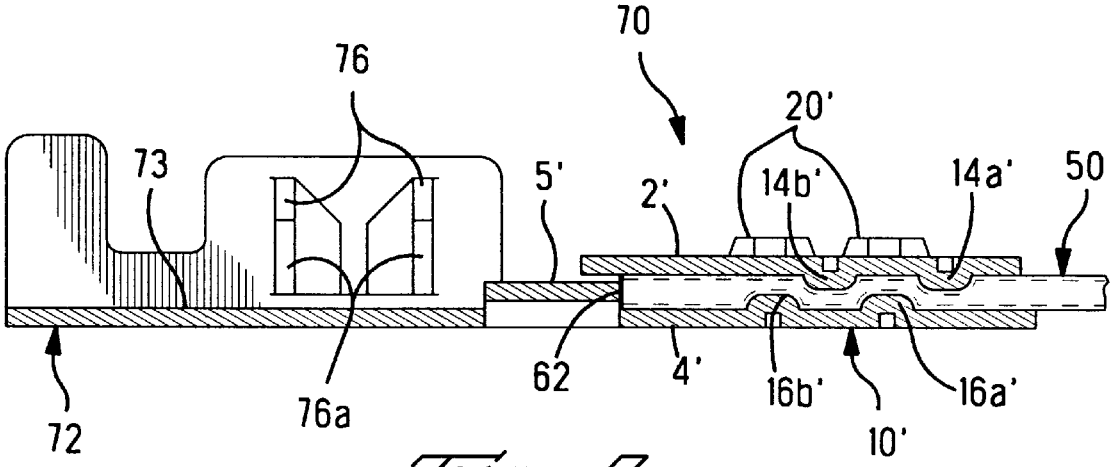
Fig. 8 Prior Art
FIG. 8 is a cross-sectional view taken along line 8—8 in FIG. 7.
Figure 9:
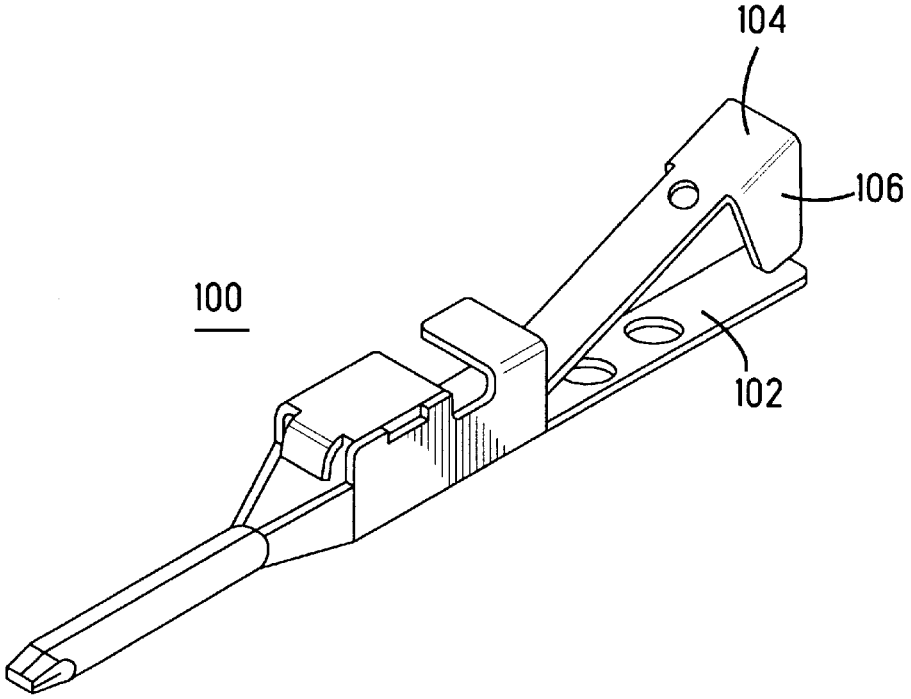
FIG. 9 is a perspective view of a conventional electrical contact.

Next, FIGS. 7 and 8 show contact 70 and contact section 10' as an alternative embodiment. The difference between contact 70 and contact 1 is that contact 70 has a termination section 72 for electrical connection with the electrical wire W by means of insulation displacement rather than crimping. Furthermore, in the description of this embodiment, parts which are the same as in the preceding first embodiment will be labeled with the same reference numbers followed by a prime. The termination section 72 of the contact 70 has side walls 74 oriented in an upright position on both sides of a bottom wall 73. The side walls 74 have substantially rectangular sections 78 in which two pairs of contact plates 76 are cut and moved inward, and insulation-engaging members 80, which are connected to the sections 78 and which are crimped onto the outer covering of the electrical wire W.

The electrical wire W is pushed by means of a tool (not shown) toward the contact plates 76, so that the outer covering of the electrical wire W is displaced by the edges 76*a* of the contact plates 76, thus establishing an electrical connection between the internal conductor (not shown) and the edges 76*a* of the contact plates 76. Afterward, the insulation-engaging members 80 are bent inward as shown in FIG. 7 and press against the outer covering so that a strain relief is provided between the electrical wire W and the contact.

Meanwhile, the contact section 10' has substantially the same structure as the contact section 10 in the first embodiment. In FIG. 7, a state is shown in which the securing members 18', 20' are bent substantially at right angles onto the plate 2' so that electrical connection to the cable 50 is accomplished.

The electrical wire W is omitted from FIG. 8. Here, it will be seen that the cable 50 is pressed by the differently positioned protruding ribs 14*a'*, 14*b'*; 16*a'*, 16*b'* as in the first embodiment, so that an electrical connection with the plates 2', 4' is established. The conductive paths 52*a*, 54*a* of the cable 50 are merely pressed between plates 2', 4'; accordingly, there is no danger of scraping, and the conductive paths are not damaged. The cable 50 is securely held in a meandering or undulating state between the plates 2', 4'; accordingly, a large resistance force is established against any force acting in the direction which causes the cable 50 to be pulled out.

A bead 5', which is formed by a protrusion in the plate 4' of the contact 70 is similarly formed for reinforcement purposes. Furthermore, the end 62 of the cable 50 engages bead 5', so that the bead 5' is also used for positioning of the cable within the contact section.

The present invention has been described in detail above; however, the present invention is not limited to the described embodiments. Various modifications and alterations are conceivable. For example, it would be possible to form a plurality of connecting members on one side edge, and to install securing members pieces between the members.

It would also be possible for the ends of the securing members 18, 20 to bow slightly upward, so that the plate 2 is strongly pressed at the end.

In the contact of the present invention, separate plates, which have projections and which are integrally connected to each other in a substantially parallel configuration by a connecting member at one side edge are pressed together so that a cable is held therebetween, and the two plates are guided by securing members located in the vicinity of the projections.

Accordingly, the following merits of the invention are realized: specifically, since the cable is not damaged by pressing the plates together even though a high contact pressure is obtained, the reliability of electrical connection is extremely high. Since the cable is strongly held, the cable can be securely held even when a force which would tend to pull the cable out acts on the cable.

What is claimed is:

1. An electrical contact for electrical connection to a flexible flat electrical cable comprising a contact section including spaced parallel plates integrally connected along one edge by a connecting member;

a conductor-connecting section extending outwardly from one of the parallel plates for electrical connection to an electrical conductor;

inwardly-directed projections provided on one of the parallel plates; and securing members disposed on side edges of one of the parallel plates which are to guide a section of the flexible flat electrical cable between the parallel plates and to guide the other of the parallel plates toward the one of the parallel plates as the securing members are bent onto the other of the parallel plates thereby pressing the section of the flexible flat electrical cable between the parallel plates and forming an electrical connection therebetween.

2. An electrical contact as claimed in claim 1, wherein the connecting member is located at inner ends of the parallel plates and having a V-shape.

3. An electrical contact as claimed in claim 1, wherein the other of the parallel plates has inwardly-directed projections.

4. An electrical contact as claimed in claim 3, wherein the securing members disposed on one side edge of the one of the parallel plates are aligned with the inwardly-directed projections in the other of the parallel plates, and the securing members disposed on the other side edge of the one of the parallel plates are aligned with the inwardly-directed projections of the one of the parallel plates.

5. An electrical contact as claimed in claim 4, wherein the other of the parallel plates has extensions extending along the securing members.

6. An electrical contact as claimed in claim 4, wherein the inwardly-directed projections of the other of the parallel plates and the securing members in alignment therewith are offset with respect to the inwardly-directed projections in the one of the parallel plates and the securing members in alignment therewith.

7. An electrical contact as claimed in claim 1, wherein the one of the parallel plates has a bead therein between the contact section and the conductor-connecting section.

* * * * *